United States Patent [19]

Buttimer

[11] Patent Number: 4,945,341

[45] Date of Patent: Jul. 31, 1990

[54] ALARM SYSTEM FOR ELECTRICAL DEVICES

[76] Inventor: Gregory J. Buttimer, 25 S. Iowa Ave., Addison, Ill. 60101

[21] Appl. No.: 333,470

[22] Filed: Apr. 5, 1989

[51] Int. Cl.[5] ..... G08B 13/22

[52] U.S. Cl. ..... 340/568; 340/539; 340/660; 340/664

[58] Field of Search ..... 340/568, 664, 660, 539

[56] References Cited

U.S. PATENT DOCUMENTS

| | | | |
|---|---|---|---|
| 3,149,317 | 9/1964 | Brugliera et al. | 340/539 |
| 3,289,194 | 11/1966 | King | 340/571 |
| 3,425,050 | 1/1969 | Tellerman et al. | 340/571 |
| 3,500,376 | 6/1970 | Cooper | 340/539 |
| 3,550,110 | 12/1970 | Mayer | 340/539 |
| 3,633,199 | 1/1972 | Curry et al. | 340/571 |
| 3,786,468 | 1/1974 | Moffitt | 340/515 |
| 3,956,697 | 5/1976 | Néry | 324/133 |
| 4,121,201 | 10/1978 | Weathers | 340/524 |
| 4,237,450 | 12/1980 | Canez | 340/571 |
| 4,284,983 | 8/1981 | Lent | 340/568 |
| 4,293,852 | 10/1981 | Rogers | 340/568 |
| 4,337,462 | 6/1982 | Lemelson | 340/572 |
| 4,580,125 | 4/1986 | Gotanda | 340/539 |

FOREIGN PATENT DOCUMENTS 561621 8/1958 Canada .

*Primary Examiner*—Glen R. Swann, III

*Attorney, Agent, or Firm*—Marshall, O'Toole, Gerstein, Murray & Bicknell

[57] ABSTRACT

A transmitter having a normally conductive transistor is connected to a wire or other conductor wrapped around the power cord of an electrical device. Because the wire is wrapped around the power cord of the device, it senses the AC radiation generated by the power cord to couple a voltage to the transistor to render it conductive, and is capable of detecting when the power cord is unplugged from an electrical outlet. As a result, the alarm system may function as a theft detection system when connected to a portable electrical device or the system may function as a safety system when connected to life-support systems used in hospitals.

9 Claims, 1 Drawing Sheet

ALARM SYSTEM FOR ELECTRICAL DEVICES

BACKGROUND OF THE INVENTION

The present invention relates to an alarm system for electrical devices, and more particularly to an alarm system that detects whether or not an electrical device is plugged in by sensing the alternating current (AC) radiation in the electrical power cord of the electrical device.

Various types of alarm systems have been designed in the past for purposes such as theft prevention and safety, for example. In the safety area, various systems have been designed to warn of the presence of high voltages. For example, U.S. Pat. No. 3,786,468 to Moffitt discloses an electric field proximity safety detector that enables a worker, for example a crane operator, to detect the presence of a dangerous power line or other electrical source and to maintain a safe distance from it. However, there is no disclosure of an alarm system which can detect whether or not the electrical power cord of an electrical device is plugged in to a source of AC power.

In the area of theft prevention, various protection systems have been designed to prevent the theft of a portable device by sensing whether the electrical power cord of the portable device is plugged in to the electrical outlet. For example, in U.S. Pat. No. 4,237,450 to Canez, an appliance theft alarm system is described as being capable of detecting the removal of the electrical power cord of a portable electrical device, such as a television, from the power outlet. If a thief tried to steal the device, an alarm signal would be generated upon the power cord's being unplugged. However, the Canez alarm system has a number of disadvantages. A primary disadvantage is that it requires the electrical power cord of the device to be tapped into in order to connect the AC power source to the Canez alarm system. The need to make such a tap would likely discourage use of the Canez system and may well present a fire or electric shock safety hazard in case the tap was not made correctly.

SUMMARY OF THE INVENTION

These and other disadvantages of previous alarm systems are overcome by the present invention, which provides an improved alarm system that is capable of detecting when the electrical power cord of an electrical device is plugged into a source of AC power. The alarm system in accordance with the invention may be easily retrofitted to an existing electrical device or incorporated in new devices in order to protect against theft or the inadvertent unplugging of the device. The detection of the latter occurrence would be desirable when the present invention is used in connection with life-support devices in hospitals, since if such devices were inadvertently unplugged, the life of the patient could be jeopardized. Advantageously, the present invention may be utilized without the need to tap into the electrical power cord of the device.

In a preferred embodiment of the invention, a conductor is coupled to the electrical power cord of an electrical device, making substantial contact with the insulating coating of the electrical power cord. The length of the conductor is sufficient to produce a voltage in the range of approximately 1.2 to approximately five volts when the power cord is connected to a source of AC power of approximately 110 volts. A switch, which may comprise a normally conductive transistor, is coupled to the conductor and is activated when the power cord of the electrical device is disconnected from the source of AC power. Alarm means, which may comprise a transmitter and a remote receiver, generates an alarm upon the switch being activated.

In one embodiment, the conductor may comprise insulated wire having a length in the range of about 12 inches to about 36 inches. The wire is wrapped around the power cord at least about five times so that the wire is capable of sensing the connection of the power cord to a source of AC power.

In another embodiment, a portion of conductive tape or foil may be used in place of the wire. The conductive tape is affixed to the power cord of the electrical device so that approximately two to six inches of the power cord is covered by the conductive tape.

These and other objects, features, and advantages of the present invention will be apparent to those of ordinary skill in the art in view of the detailed description of the preferred embodiments, which is made with reference to the drawings, a brief description of which is provided below.

DETAILED DESCRIPTION OF THE PREFERRED EMBODIMENT

Figure 1:
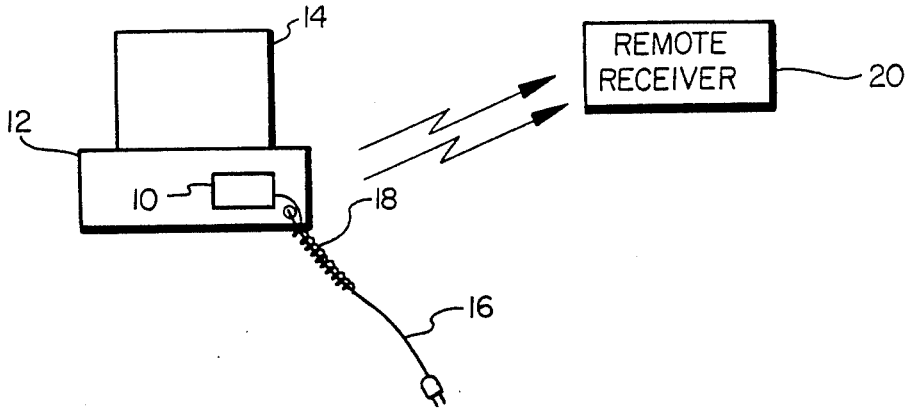
FIG. 1 illustrates one embodiment of the invention including an electrical device with a transmitter coupled to the back side of the device, a wire wrapped around the power cord of the electrical device, and a receiver remote from the transmitter.

A preferred embodiment of the invention is shown in FIG. 1. Referring to FIG. 1, a transmitter 10 is connected to the back side of an electrical device, which in this case is shown to be a computer 12 with a CRT screen 14 and an electrical power cord 16 for connection to a source of AC power, such as a typical electrical outlet. A wire 18 connected to the transmitter 10 is wrapped around the electrical power cord 16. The transmitter 10 is a conventional transmitter of the type commonly used in home burglar alarm systems which transmits radio frequency (RF) alarm signals to a receiver upon the detection of alarm conditions. A receiver 20 remote from the transmitter 10 may be used to receive RF alarm signals generated by the transmitter 10 and generate a second alarm signal, which may be a loud audible alarm or an electronic alarm signal that is transmitted to a local police station, for example. A transmitter and receiver suitable for use in the present invention are commercially available as a package from Interactive Technologies of Minneapolis, Minnesota as Model SX-V.

Figure 2:
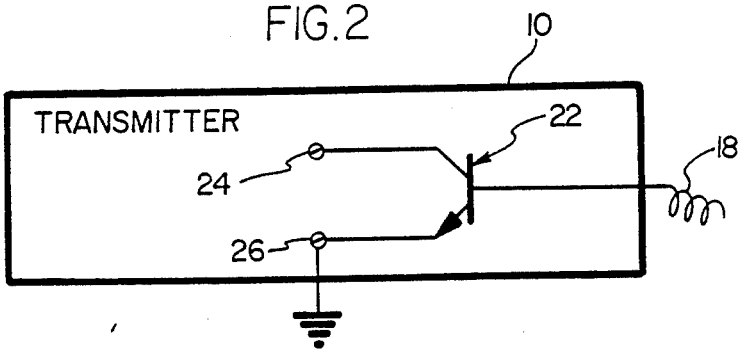
FIG. 2 illustrates the transmitter of FIG. 1 in more detail.

Now referring to FIG. 2, a transistor 22 is electrically coupled to the transmitter 10 by means of two preexisting screw connections 24, 26 on the transmitter 10. The connection 24 is connected to the collector of the transistor 22 and the connection 26 is connected to the emitter of the transistor 22. The connection 26 is also connected to ground, which would preferably be the chassis of the computer 12. The ground connection could be made by using a conductive foam or screw to connect the transmitter 10 to the computer chassis. The base of the transistor 22 is connected to the wire 18, only a portion of which is shown in FIG. 2. The transistor 22, which is shown to be an npn type transistor, acts as a normally conductive switch which is activated when the power cord 16 is disconnected from a source of AC power. If the input capacitance of the transmitter 10 is not sufficiently large enough, it may be necessary to add a relatively small capacitor (not shown), of about 0.01 to 0.10 microfarads, in parallel with the transistor 22 and across the connections 24, 26.

The purpose of the wire 18 is to capacitively couple the transistor 22 to the electrical power cord 16. The power cord 16 is a conventional cord and comprises two or three conductors surrounded by an insulating coating. Where three conductors are provided, one conductor is for the ground connection. Preferably, the wire 18 consists of a single, flexible stranded, axial conductor within an insulating coating. When the wire 18 is wrapped around the outside of the power cord 16 and makes substantial contact with the insulating coating of the power cord, the combination of the wire 18 and the power cord 16 can be viewed as a capacitor, with the conductors of the power cord 16 representing one plate of the capacitor, the conductor of the wire 18 representing the other plate of the capacitor, and the insulating coatings of the power cord 16 and wire 18 acting as the dielectric between the plates of the capacitor.

Due to the wire 18 being coupled to the power cord 16, the wire 18 is capable of sensing the connection of the power cord 16 to a source of AC power, i.e. an electrical outlet. As long as the power cord 16 is connected to an outlet, the wire 18 senses the electrical radiation generated by the power cord 16 and causes a voltage to be transmitted to the base of the transistor 22. Upon disconnection of the power cord 16 from the outlet, the wire 18 no longer senses electrical radiation, and no voltage is transmitted to the base of the transistor 22.

Figure 3:
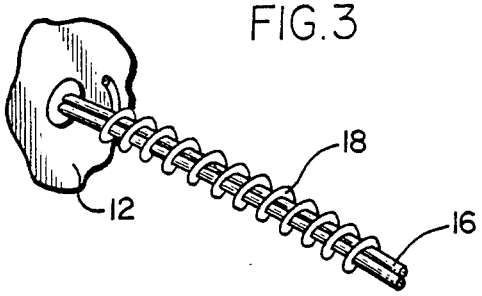
FIG. 3 is a perspective view of a portion of the electrical power cord of FIG. 1 showing the wire wrapped around the electrical power cord.

Referring to FIG. 3, the manner in which the wire 18 is coupled to the power cord 16 is shown in more detail. The wire 18 is shown to be wrapped around the power cord 16 approximately 10 times. The wire 18 may be 16 AWG MTW and preferably has a length in the range of approximately 24 inches to approximately 36 inches so that the wire 18 may be wrapped around the power cord about nine to 12 times. The wire may be as short as 12 inches in length so that it may be wrapped around the power cord 16 about five times and still sense the presence of electrical radiation in the power cord 16. However, the length of the wire 18 is preferably in the range set forth above to reduce the likelihood of false alarms.

When the length of the wire 18 is within the approximate 24 to 36 inch range, a voltage in the range of approximately 1.2 to 1.6 volts is generated at the base of the transistor 22 when the power cord 16 is connected to a source of AC power of approximately 110 volts. The wire 18 may be made longer so that the voltage at the base of the transistor 22 may be as high as approximately five volts. As long as the voltage is in the approximate range of 1.2 to five volts, the transistor 22 will be held in its conductive state and, as explained below in connection with the operation of the system, the system will not generate an alarm.

Figure 4:
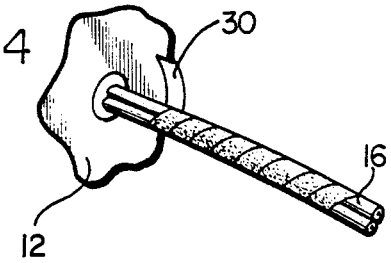
FIG. 4 is a perspective view of a portion of an alternative embodiment of the invention showing a portion of an electrical power cord wrapped with conductive tape.

Now referring to FIG. 4, a piece of conductive tape or foil 30 may be used instead of the wire 18. The function of the tape 30, which is the same as that of the wire 18, is to sense the AC radiation generated by the power cord 16 and supply a voltage to the base of the transistor 22 to keep it in the conductive state. The tape 30 is wrapped spirally around the exterior of the power cord 16 to completely cover the cord 16 for a length of approximately four to six inches. To cover this length of cord, the length of the tape would vary, depending upon its width.

The use of tape or metallic foil gives more efficient coupling between the transistor 22 and the power cord 16 because 1) the surface area of the tape is greater (the tape may cover the entire outside portion of the power cord 16) and 2) the distance between the conductive portion of the tape and the conductors in the power cord 16 is less than the corresponding distance between the conductor of the wire 18 and the conductors in the power cord 16 (because the wire 18 is insulated and the resulting insulation slightly increases the distance between the conductor in the wire 18 and the conductors in the power cord 16). A conductive tape such as Scotch brand #425 aluminum tape has been found to be satisfactory. When tape is used, the exterior of the tape should be insulated, for example by wrapping insulating electrical tape over the conductive tape, because the touching of the conductive tape by a person's hand would shunt the voltage at the base of the transistor 22 and trigger a false alarm.

Figure 5:
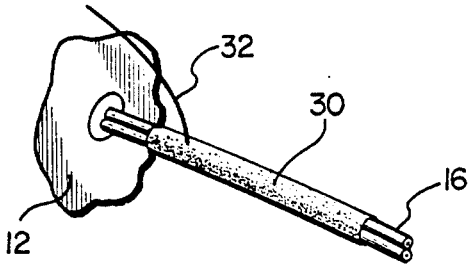
FIG. 5 is a perspective view of a portion of an alternative embodiment of the invention showing a portion of an electrical power cord having conductive tape affixed thereto in a direction parallel to the power cord.

Alternatively, instead of being spirally wrapped around the power cord 16, the tape 30 may be affixed to the power cord in a direction parallel to the cord as shown in FIG. 5. In this case, the tape 30 may cover the exterior of the cord partially or completely for the preferred length of about four to six inches. Since the tape 30 is affixed to the power cord 16 parallel to the cord, the length of tape required would be equal to the portion of the cord to be covered. Thus, if a four inch portion of cord were to be covered, four inches of tape would be necessary. A wire lead 32 may be used to connect the tape 30 to the base of the transistor 22. If a transistor 22 having a relatively high gain is used, only about two inches of conductive tape would be necessary instead of four inches of tape.

Because either wire or tape could be used as the conductor 18, the preferred length of the conductor is in the approximate range of two inches to 36 inches.

In the operation of the alarm system, the wire 18 (or tape or other conductor), which is capacitively coupled to the power cord 16, senses the presence of AC radiation generated by the power cord 16 as a result of the cord 16 being connected to a source of AC power, which is typically 60 Hz at 110 volts as provided by most electrical outlets, regardless of whether the electrical device is turned on or is drawing any current from the power source. The source of AC power may also be at 50 Hz and either 208 or 220 volts. As a result of the electrical radiation generated by the cord 16 and detected by the wire 18, the wire supplies a sufficiently high voltage, for example 1.2 to five volts, to hold the transistor 22 connected to the wire 18 in the on state, or conductive, as long as the cord 16 remains connected to an electrical outlet. As long as the transistor 22 is conductive, meaning that no alarm condition exists, the transmitter 10 does not generate any alarm signal for transmission to the receiver 20.

Upon the power cord 16 being disconnected from an AC outlet by being unplugged, cut, or by any other way of disconnection, the wire 18 ceases to sense the presence of electrical radiation from the cord 16, and thus the wire no longer provides a high enough voltage to keep the normally conductive transistor 22 in the on state. As a result, the transistor 22 is turned off, and the transmitter 10 senses the presence of an alarm condition and generates an RF alarm signal to the remote receiver 20.

Because of its ability to sense the disconnection of the electrical power cord from an electrical outlet, the present invention may be used as a theft prevention system to prevent the theft of computers and other portable devices from offices or televisions from hotels, for example. Alternatively, the present invention may advantageously be used to sense the inadvertent unplugging of life-support systems in hospitals. Of course, there may be other uses for the present invention other than the uses described specifically herein.

While the present invention has been shown to include either a wire or conductive tape for sensing AC radiation, all that is necessary is that conductive material be wrapped around or otherwise affixed to the electrical power cord 16. Accordingly, conductive materials other than in the form of wire or tape may be used while still retaining the benefits of the invention. The combination of the transmitter and receiver could be replaced with another means for generating an alarm signal, such as one that would produce a loud audible alarm.

Modifications and alternative embodiments of the invention will be apparent to those skilled in the art in view of the foregoing description. Accordingly, this description is to be construed as illustrative only, and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. An apparatus comprising:

an electrical device having an electrical power cord, said electrical power cord comprising two conductors surrounded by an insulating coating;

a wire wrapped around said power cord of said electrical device, said wire making substantial contact with said insulating coating of said power cord, said wire having a length in the range of about 12 inches to about 36 inches, said wire being wrapped around said power cord at least about five times so that said wire is capable of sensing the connection of said power cord to a source of AC power whether or not said electrical device is turned on;

an amplifier electrically coupled to said wire, said amplifier detecting when said power cord of said electrical device is disconnected from the source of AC power;

a transmitter electrically coupled to said amplifier, said transmitter generating an RF alarm signal upon said amplifier's being turned off in response to said power cord's being disconnected from the source of AC power; and a receiver remote from said transmitter, said receiver receiving said RF alarm signal from said transmitter and generating a second alarm signal in response to receiving said RF alarm signal.

2. An apparatus comprising:

an electrical device having an electrical power cord, said electrical power cord comprising two conductors surrounded by an insulating coating;

a third conductor attached to said power cord of said electrical device, said third conductor making substantial contact with said insulating coating of said electrical power cord, said third conductor having a length sufficient to produce a voltage in the range of approximately 1.2 volts to approximately 5 volts when said power cord is connected to a source of AC power of approximately 110 volts;

a switch electrically coupled to said third conductor, said switch being activated when said power cord of said electrical device is disconnected from said source of AC power; and means electrically coupled to said switch for generating an alarm signal upon said switch's being activated.

3. An apparatus as defined in claim 2 wherein said means for generating an alarm signal comprises a transmitter that transmits an RF alarm signal to a receiver remote from said transmitter.

4. An apparatus as defined in claim 2 wherein the activation of said switch occurs upon said switch's becoming nonconductive.

5. An apparatus as defined in claim 4 wherein said switch comprises a transistor.

6. An apparatus comprising:

an electrical device having an electrical power cord, said electrical power cord comprising two conductors surrounded by an insulating coating;

a third conductor coupled to said power cord of said electrical device, said third conductor making substantial contact with said insulating coating of said electrical power cord, said third conductor being capable of detecting the connection of said electrical power cord to a source of AC power;

a switch electrically coupled to said third conductor, said switch being activated when said power cord of said electrical device is disconnected from the source of AC power; and means electrically coupled to said switch for generating an alarm signal upon said switch's being activated.

7. An alarm system comprising:

a conductor capable of being coupled to the exterior of the electrical power cord of an electrical device, said conductor having a length in the range of about two inches to about 36 inches so that said conductor is capable of sensing the connection of the power cord to a source of AC power whether or not the electrical device is turned on by sensing the electrical radiation generated by said cord's being plugged in;

a switch electrically coupled to said conductor, said switch detecting when the power cord of the electrical device is disconnected from the source of AC power; and means electrically coupled to said switch for generating an alarm signal in response to said switch's detecting when the power cord of the electrical device is disconnected from the source of AC power.

8. An apparatus comprising:

an electrical device having an electrical power cord, said electrical power cord comprising two conductors having an insulating coating;

a third conductor coupled to said power cord of said electrical device, said third conductor and said two conductors of said power cord being capacitively coupled via said insulating coating of said power cord whereby said third conductor is capable of detecting the connection of said electrical power cord to a source of AC power by sensing the electrical radiation generated by said cord's being plugged in;

a switch coupled to said third conductor, said switch being activated when said power cord of said electrical device is disconnected from the source of AC power; and an alarm signal generator coupled to said switch that generates an alarm signal in response to said switch's being activated.

9. An alarm system comprising:

a conductor for capacitive coupling to the electrical power cord of an electrical device, said conductor sensing the connection of the power cord to a source of AC power whether or not the electrical device is turned on by sensing the electrical radiation generated by said cord's being plugged in;

a switch electrically coupled to said conductor, said switch detecting when the power cord of the electrical device is disconnected from the source of AC power; and an alarm signal generator coupled to said switch, said alarm signal generator generating an alarm signal in response to the detection by said switch of the disconnection of the power cord from the source of AC power.

* * * * *